United States Patent [19]

Lager et al.

[11] Patent Number: 5,009,039

[45] Date of Patent: Apr. 23, 1991

[54] SKATE SHARPENING DEVICE

[75] Inventors: Kjell Lager, Österbybruk; Anders Tärnström, Storvreta; Olov Östlund, Uppsala, all of Sweden; Joseph W. Driver, Hudson Heights, Canada

[73] Assignee: Svenska Skatebox AB, Uppsala, Sweden

[21] Appl. No.: 458,624

[22] PCT Filed: Jul. 14, 1988

[86] PCT No.: PCT/SE88/00379

§ 371 Date: Mar. 16, 1990

§ 102(e) Date: Mar. 16, 1990

[87] PCT Pub. No.: WO89/00443

PCT Pub. Date: Jan. 26, 1989

[30] Foreign Application Priority Data

Jul. 17, 1987 [SE] Sweden ..... 8702909

[51] Int. Cl.[5] ..... B24B 49/12; B24B 3/00; B24B 19/00

[52] U.S. Cl. ..... 51/165.77; 51/92 BS; 51/228; 51/91 BS

[58] Field of Search ..... 51/228, 91 R, 91 BS, 51/92 R, 92 BS, 102, 34 E, 34 C, 45, 426, 268, 322, 411, 412, 269, 271, 272, 274, 285, 215 R, 158, 165.76, 165.77; 83/DIG. 1; 52/32

[56] References Cited

U.S. PATENT DOCUMENTS

| | | | |
|---|---|---|---|
| 2,438,543 | 3/1948 | Custin et al. | 51/34 F |
| 3,735,533 | 5/1973 | Salberg | 51/34 E |
| 3,827,185 | 8/1974 | Smith | 51/5 D X |
| 4,235,050 | 11/1980 | Hannaford et al. | 51/34 D |
| 4,534,134 | 8/1985 | Consay et al. | 51/96 |

FOREIGN PATENT DOCUMENTS

| | | |
|---|---|---|
| 0128320 | 12/1984 | European Pat. Off. . |
| 2255038 | 1/1974 | Fed. Rep. of Germany . |

*Primary Examiner*—Frederick R. Schmidt
*Assistant Examiner*—Bruce P. Watson
*Attorney, Agent, or Firm*—Bacon & Thomas

[57] ABSTRACT

An automatic skate sharpener comprises a skate sharpening mechanism inside a cover. A skate loading device is pivotally mounted in an opening in the protective cover, so that it can be pivoted between a loading position, in which the skate is on the outside of the protective cover, and a starting position for sharpening of a skate, in which the skate is on the inside of the protective cover. The skate loading device comprises a gripping device for releasably gripping at least one skate to be sharpened, first obturation device which substantially closes the opening in the skate loading position, and second obturation device which substantially closes the opening in the starting position.

10 Claims, 6 Drawing Sheets

SKATE SHARPENING DEVICE

TECHNICAL FIELD

The present invention relates to devices and machines for skate sharpening and especially to all-automatic devices and machines of this kind.

BACKGROUND OF THE INVENTION

Skating has become increasingly popular, i.a. thanks to the great increase of the number of artificially frozen ice-hockey rinks and skating arenas. In connection therewith also the need of sharpening of the skates has increased considerably. At the same time the requirements of the quality of the sharpening have increased, e.g. as regards ice-hockey and figure skates.

At present, almost all sharpening of skates is performed manually or semi-automatically, the skates being braced in a jig or the like and a rotating grinding wheel being passed over the skate blade a desired number of times. Not only the manual, but also the semi-automatic sharpening method requires a certain sharpening skill of the operator, and the sharpening procedure is time-consuming.

There is thus a great need of fully automated skate sharpening machines, which do not require any skilled operator but can be used by anybody, and which provide for a rapid sharpening of high quality. As far as we know there is no all-automatic skate sharpening machine on the Swedish market, but there are several proposals for such machines in the patent literature, e.g. in U.S. Pat. Nos. 2,438,543, 3,735,533, 3,827,185 and 4,235,050. These previously disclosed automatic skate sharpening machines have deficiences in various respects, and the present invention relates to improvements, simplifications and developments of the known skate sharpening devices.

OBJECT OF THE INVENTION

It is an object of the invention to provide an improved, simplified and safer device for the loading of skates into all-automatic skate sharpening machines.

Another object of the invention is to provide for simplified sensing of the skate length, with consequent simplification of the mechanisms for gripping the skate and guiding the same when passing the grinding wheel during the sharpening process.

A further object of the invention is to provide an all-automatic skate sharpening machine, which has a simple, rugged and reliable design, is very simple to use and meets high demands as regards the quality of the sharpening.

These and other objects of the invention, which will become evident—directly or indirectly—from the following description of preferred embodiments, are achieved in that the skate sharpening devices have been given the characteristics indicated in the appended claims.

SHORT DESCRIPTION OF THE DRAWINGS

The enclosed drawings shown the following:

DESCRIPTION OF PREFERRED EMBODIMENTS

Figure 1:
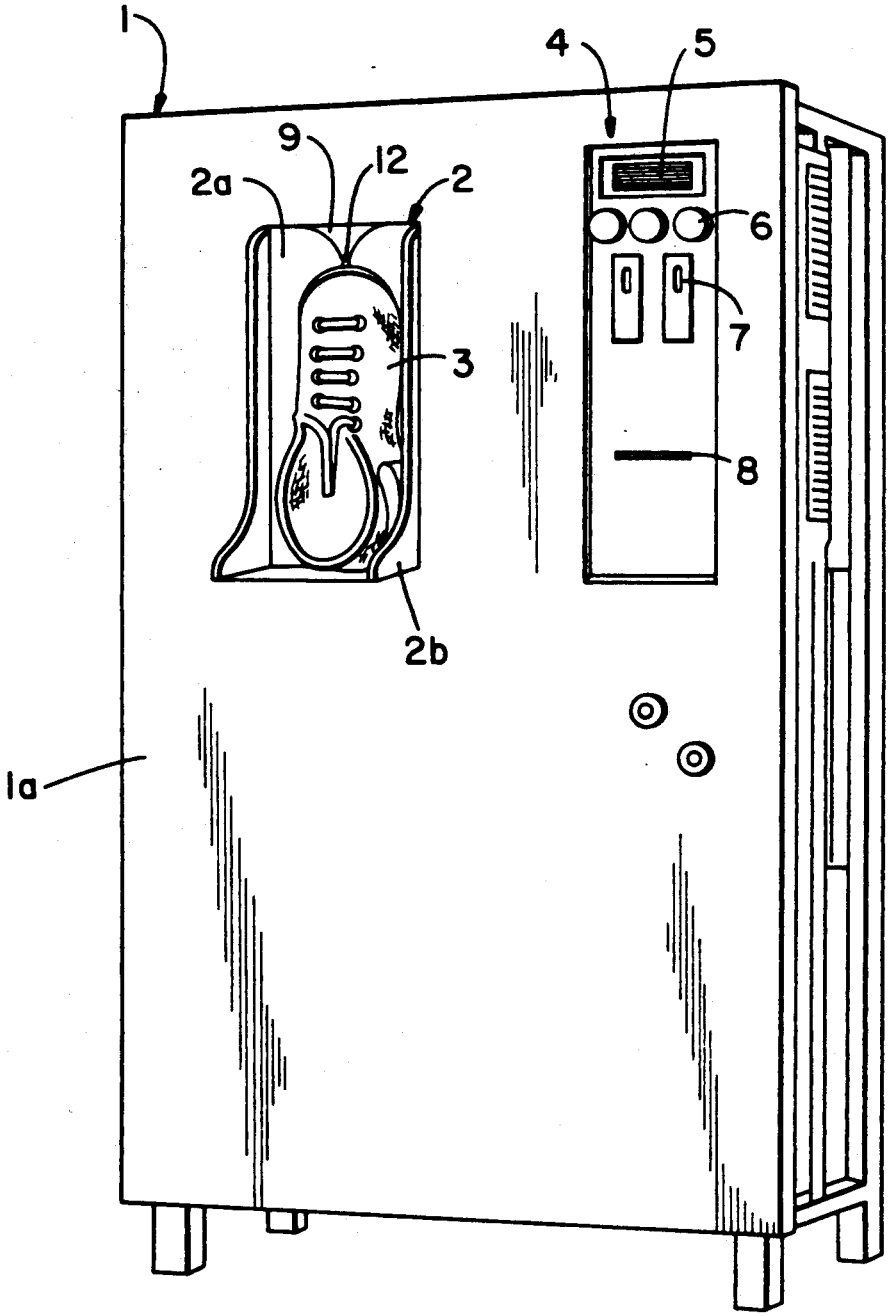
FIG. 1 is a schematic oblique front perspective view of a preferred embodiment of an automated skate sharpening machine according to the invention.

FIG. 1 substantially shows the front of a preferred embodiment of a skate sharpening machine according to the invention, i.e. the side facing the user. The skate sharpening machine is generally designated by the reference numeral 1 and its front wall is designated 1*a*. Although only the front wall 1*a* is shown in the drawings, it is to be understood that also the other sides of the skate sharpening machine (the top and bottom sides included) in use are covered with robust cover plates preventing the user from getting access to the inside of the skate sharpening machine. On the front wall 1*a* there is shown a skate loading device 2 having a schematically shown skate 3 inserted therein. The main function of the loading device 2 is to feed the skate 3 to be sharpened from the loading position outside the skate sharpening machine 1, as shown in FIG. 1, to a correct starting position for sharpening inside the machine. The loading device 2 is an essential part of the skate sharpening machine 1 and will be described in detail below, especially with reference to FIGS. 5 and 6.

On the front wall 1*a* there is also a control and indicator panel 4, which in the shown embodiment comprises an instruction text window 5, function selector buttons 6, slots 7 for inserting coins, and/or a slot 8 for receiving credit cards, account cards, payment cards or the like. The functions of the control and indicator panel 4 are basically to receive the customer's payment through the coin slots 7 or the card slot 8, to give instructions to the customer through the text window 5, and to receive the customer's selection as regards type of grinding, etc. through the selector buttons 6. The latter can, for example, give the client the possibility to select the desired skate type (such as ice-hockey or figure skates), the desired degree of sharpening (such as one or two sharpening cycles), etc.

The text window 5 displaces relevant information and instructions to the customer (or service personnel), for example indicating that the machine is occupied, informing about ongoing working moments, instructing about how and when to pay, select the desired skate type and the degree of sharpening, insert a skate into or remove a skate from the loading device 2, producing error messages, etc. The coin slots 7, the card sensor 8, the selector buttons 6 and the text window 5 all represent technology which is well known per se in connection with different types of automats and will therefore not be described any further herein.

In the previously known automatic skate sharpening machines referred to above the skates are loaded into the machine from the top side and placed directly into the jaws or the like keeping the skate clamped during the sharpening operation. It is often required that the customer perform further working moments, such as positioning slide pieces against the front and rear edges of the skate in order to determine the length and position of the skate. Such a design gives the customer access to the interior mechanisms of the machine. This in turn creates a risk for damages both on the customer and the machine, necessitating complex mechanisms for closing the machine when the skate has been positioned.

Figure 4:
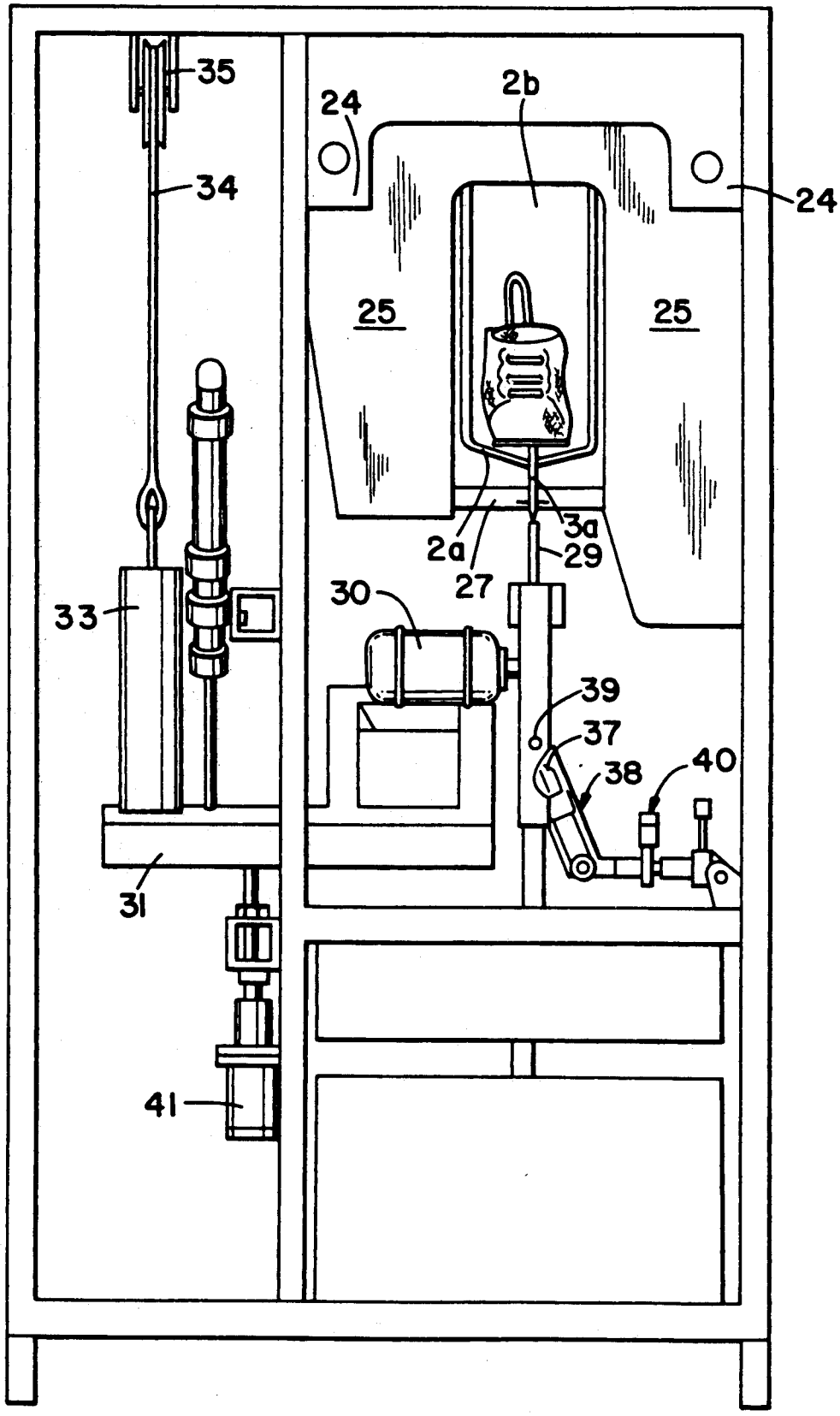
FIG. 4 is a rear view of the skate sharpening machine according to FIGS. 1–3, the rear wall having been removed.
Figure 5:
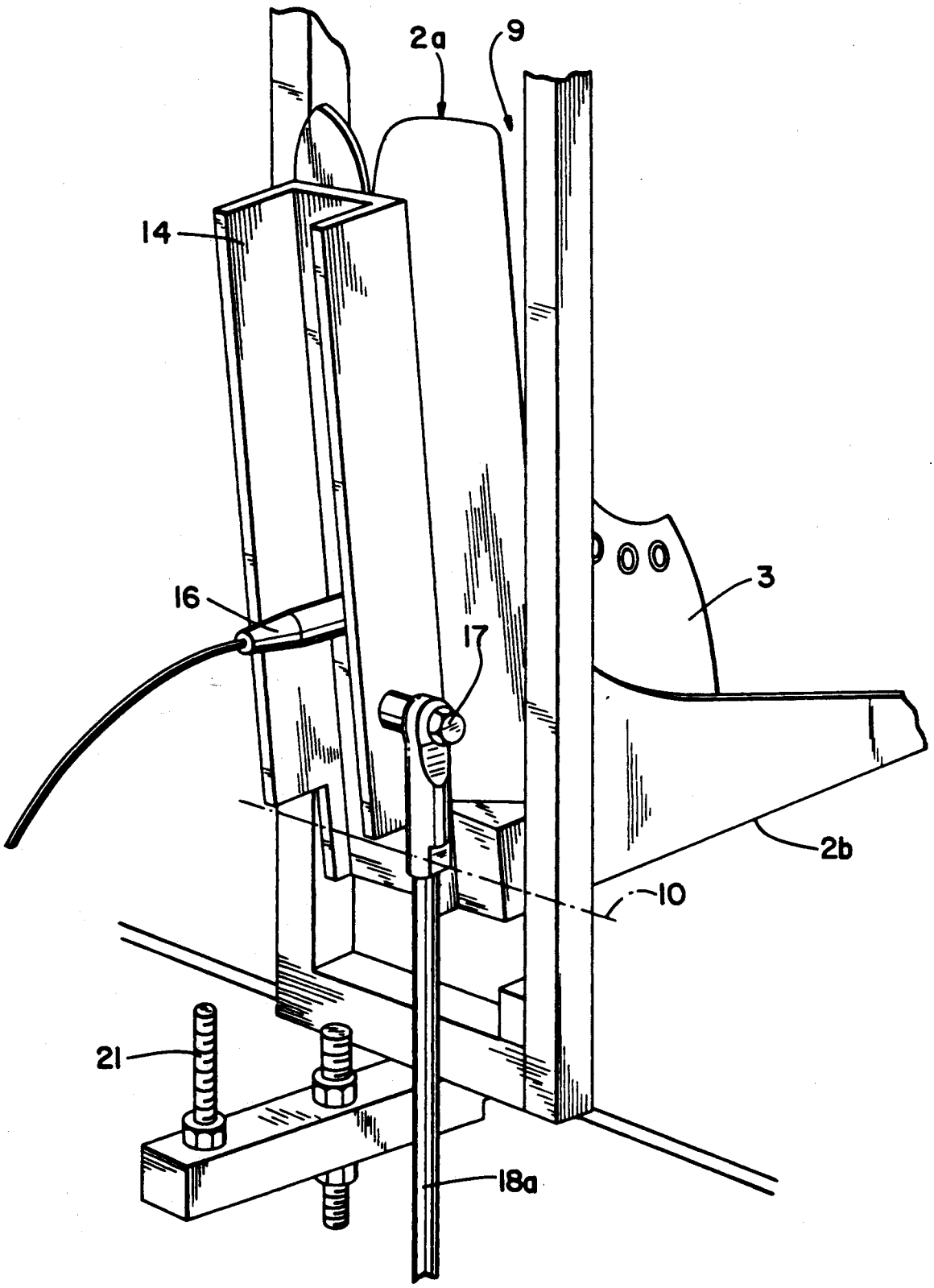
FIGS. 5 and 6 are perspective views of a skate loading device according to the invention forming part of the skate sharpening machine shown in FIGS. 1–4, viewed from the inside of the machine and shown in the loading position and in the starting position for sharpening respectively.
Figure 6:
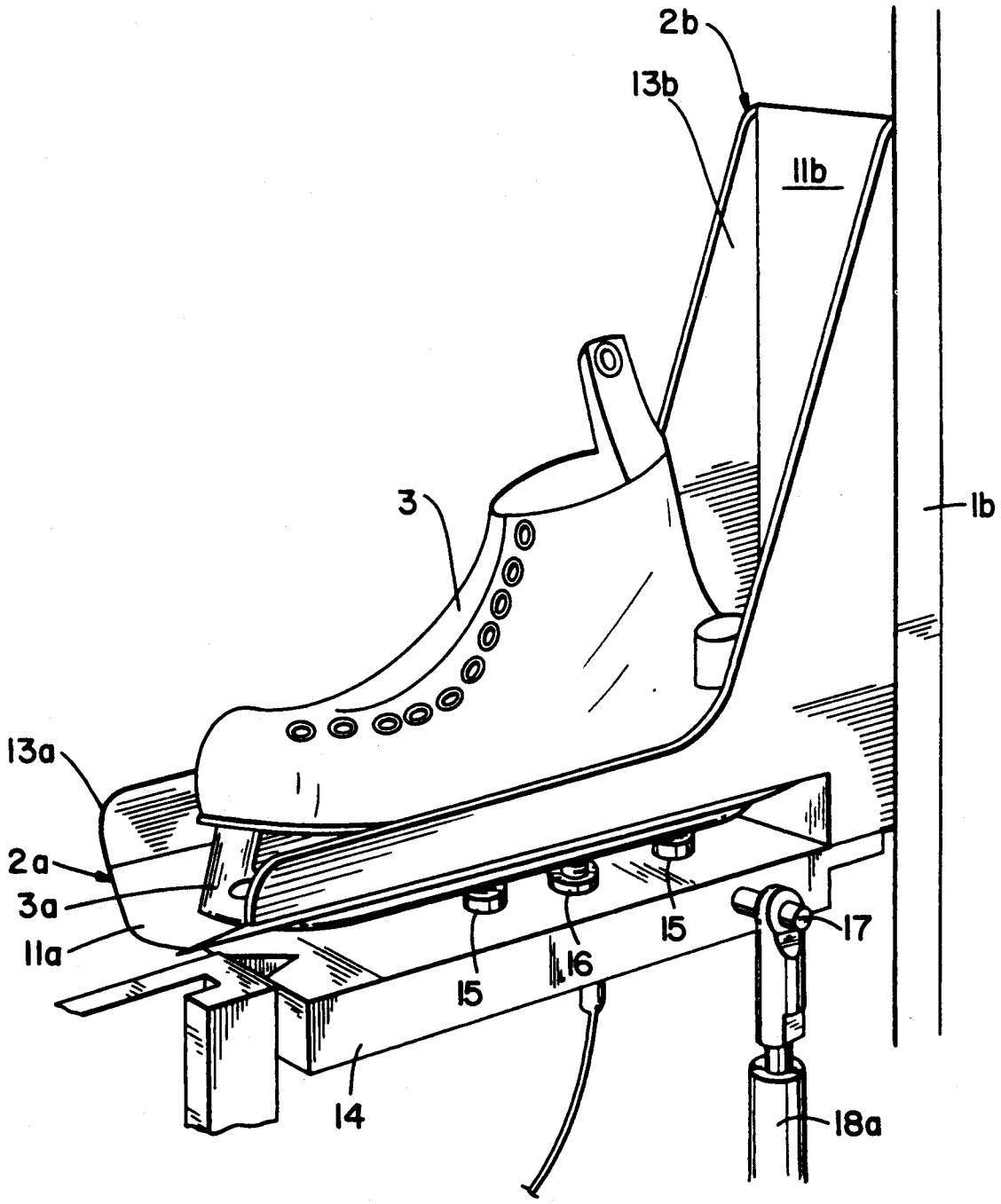

As is best seen from FIGS. 5 and 6, which show the skate loading device 2 viewed from the interior of the skate sharpening machine (compare also FIGS. 1, 2 and 4), the loading device 2 according to the invention is so designed that it does not give the user access to the interior mechanisms of the skate sharpening machine. The loading device 2 according to the invention comprises as a substantially L-shaped door mounted in a matching opening 9 in the front plate 1*a*. The door 9 has two shanks 2*a* and 2*b*, which preferably are of equal length, i.e. the door has the basic shape of a right angle isosceles triangle. At the point of the triangle the door 2 is pivotally journalled on a shaft 10 mounted in the frame 1*b* of the front wall 1*a*, so that the door can be swung, by pivoting around the axis 10, from the loading position in which the skate 3 is located outside the front wall 1*a* (FIGS. 1 and 5) to the position in which the skate 3 is located inside the skate sharpening machine in the starting position for sharpening (FIGS. 2, 4 and 6).

Figure 2:
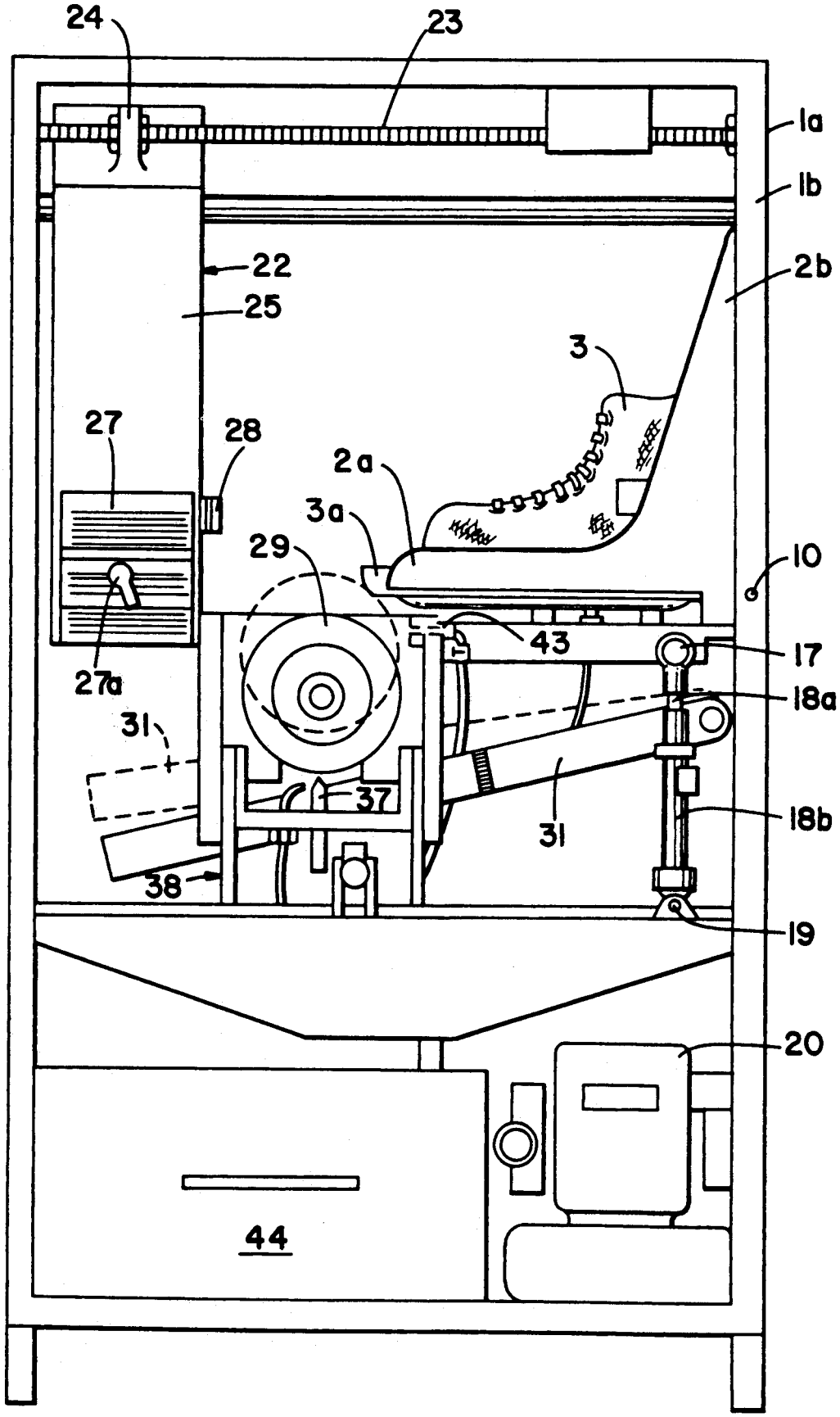
FIG. 2 is a first side elevational view of the skate sharpening machine shown in FIG. 1, the side wall having been removed.
Figure 3:
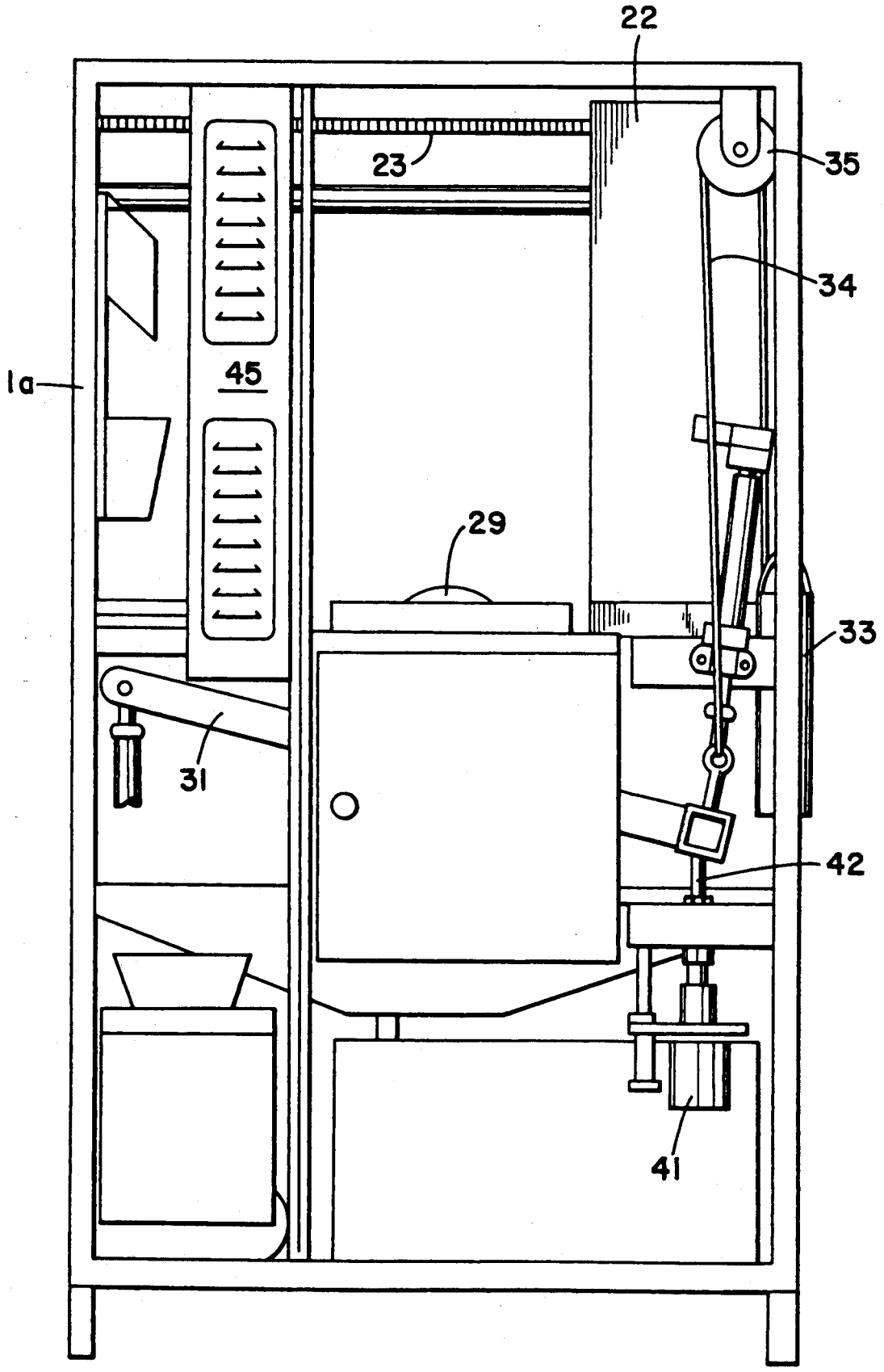
FIG. 3 is a side elevational view corresponding to FIG. 2 and showing the opposite side of the skate sharpening machine.

Both shanks 2*a* and 2*b* are so designed that they substantially obstruct the loading opening 9 in the respective end positions, i.e. so that the shank 2*a* substantially closes the opening 9 when the door 2 is in the loading position (FIGS. 1 and 5), and that the opening 9 is kept closed by the shank 2*b* when the skate 3 is located inside the skate sharpening machine (FIGS. 2, 4 and 6). In the shown embodiment bottom portions 11*a* and 11*b* respectively of the shanks 2*a*, 2*b* keep the opening closed. The bottom portion 11*b* is preferably formed by a continuous plate or the like, whereas the bottom portion 11*a* is provided with a central longitudinal slot 12, into which the skate 3 is to be inserted. Both bottom portions 11*a*, 11*b* preferably also are provided with outstanding edge portions 13*a*, 13*b*.

A plate or U-shaped channel beam 14 is mounted beneath the bottom portion 11*a* at a suitable distance from the same. The plate 14 carries one or more magnets 15 and one or more sensors 16, such as inductive sensors. The plate 14 further carries a pivot 17, on which the end of the piston 18*a* of a piston/cylinder unit 18 is pivotally journalled. The cylinder 18*b* of the unit is pivotally journalled on a stationary frame in the machine (at 19), and the unit is driven by a suitable power source, such as a compressor 20.

The plate 14 serves as an adjustment, clamping and control means when a skate blade 3*a* is inserted into the slot 12 in the bottom portion 11*a* of the door, as is illustrated in FIG. 1. When a skate is correctly inserted into the slot 12, its blade 3*a* will be attached by the magnets 15, which hold the blade because of their magnetic force. The sensor 16 senses the position of the blade and produces an error signal if the position of the blade 3*a* is not correct. The other bottom portion 11*b* of the door at the same time serves as a stop for the trailing edge of the skate blade (the skate 3 being moved by gravity towards said bottom portion), so that the skate will be in a well defined rear position in the slot 12.

The door 2 carrying the skate 3 is moved to the starting position for sharpening (FIG. 6) by operation of (i.e. shortening of) the piston/cylinder unit 18. The plate 14 will in this position rest on an adjustable stop means such as a set screw 21.

The above described skate loading device 2 according to the invention has now fulfilled the duty to safely load the skate into a well defined starting position inside the skate sharpening machine 1. The very sharpening procedure can, in principle, be performed by means of devices having any suitable design capable of carrying out the sharpening automatically and returning the skate 3 to the starting position shown in FIG. 6. The device 2 is then again activated to return the sharpened skate 3 to the customer, this being done by operation of the piston/cylinder unit 18 in the opposite direction (i.e. extension of the unit).

In other aspects of the invention it is, however, preferable to use the loading device 2 in combination with a special automatic skate sharpening device shown in the drawings, and in particular in combination with a novel center determination device which will be described below.

The skate sharpening machine shown in the drawings is at its top portion provided with a slide 22, carried by two rods 23. These rods are parallel with each other and extend between the front and rear sides of the machine. The slide 22 hangs on the rods 23 which pass through lugs 24 symmetrically provided on the slide. The slide has the basic shape of an inverted U, having two side pieces 25 defining a central passage 26 therebetween, aligned with the skate 3. The movement of the slide 22 along the guide rods 23 is controlled steplessly by a suitable motor.

In its resting position the slide 22 is retracted towards the rear of the skate sharpening machine (see e.g. FIG. 2). After the loading device 2 has moved the skate 3 to the correct starting position for sharpening, as described above, the slide 22 is moved towards the skate 3 in order to fetch the same by clamping the skate blade 3*a* between two jaws 27. The jaws 27 have to grip the skate blade 3*a* at the mid-point thereof (in the longitudinal direction). In accordance with the invention the mid-point determination is performed in very simple manner by means of only one position measurement, viz. by detecting the position of the skate 3 and/or of the blade 3*a* by means of a photocell or some other position sensing device 28 provided on the slide 22 on level with the skate/skate blade. When the front edge of the skate breaks the light beam in the sensor device 28, this is recorded. As pointed out earlier the loading device 2 ensures that the trailing edge of the skate blade 3 always will have the same position irrespective of the length of the skate/skate blade. This means that the mid-point of the blade will be unambigously determined by the single position measurement made by the photocell (the mid-point=half the distance between the detected position and the predetermined position for the rear edge of the skate blade). A corresponding signal is sent to the drive motor of the slide 22 so as to stop the slide at the mid-point calculated in said manner.

The jaws 27, which are driven by a suitable power source (such as compressed air from the compressor 20 as is intimated by a compressed air connection 28*a* in FIG. 2), will now be operated to clamp the skate blade 3*a* (compare FIG. 4). It is possible to use either two movable jaws 27 or one stationary and one movable jaw, the latter alternative often being preferable for simplicity reasons.

When the skate blade 3*a* has been clamped between the jaws 27, the driving motor for slide 22 is reversed, the slide starts moving in the opposite direction, and a grinding wheel 29 is started. The grinding wheel is driven by a suitable motor 30 and is mounted in a pivoting holder or "swinging arm" 31, one end of which is pivotally journalled at 32 and the opposite end of which is biased upwards by a weight 33 via a cord and pulley wheel 34, 35. Thus, in the free position the grinding wheel 29 is biased by the weight 33 towards an upper position, which is above the level of the skate blade to be sharpened. When the blade 3a, carried by the slide 22, passes over the grinding wheel 29, it presses the wheel 29 downwards (compare the full line and dashed line positions in FIG. 2), the necessary sharpening force being provided by the weight 33. This manner of applying the sharpening force has proven to produce very good sharpening results, and one single sharpening cycle is in most cases sufficient when using the device according to the invention.

After the sharpening has been completed the slide 22 is returned to the loading device 2, where it delivers the skate 3 by loosening the jaws 27. The device 2 now operated to return the sharpened skate to the customer, as described above, and the drive motor returns the slide to its resting position.

If the customer has selected sharpening of figure skates (by pressing a corresponding function selector button 6), then the sharpening process is adjusted so as to take into consideration that the blades of figure skates have a toothed front portion which should not be sharpened. In such a case the grinding wheel 29 is not started until the toothed toe portion has passed the grinding wheel. Because of the above described device for sensing the length of the skate, it is also simple to determine the position for starting the grinding wheel 29. It has thus been found that the length of the toothed toe portion is relatively independent of the skate length, and that minor variations in practice do not harm the quality of the sharpening. Therefore, the grinding wheel can be started when the slide has moved a standardized distance form the starting position corresponding to the edge of the skate.

After the sharpening procedure has been repeated for the second skate, the slide 22 is finally returned to its resting position. Before the skate sharpening machine is ready to be used by the next customer, the grinding wheel 29 preferably should be dressed to make it possible to maintain a high sharpening quality and a constant contour of the sharpening. This normally means that the grinding wheel is given a controlled convex contour, which in turn means that the skate blade will be hollow-ground.

Thus, the skate sharpening machine according to the invention is preferably provided with a mechanism 36 for dressing the grinding wheel 29, similarly to previously known skate sharpening automates. As best appears from FIG. 4 the dressing mechanism 36 comprises a diamond 37 cooperating with the grinding wheel 29 and supported by a "cradle" 38, which can be rocked to-and-fro around an axis 39, driven by e.g. compressed air from a compressor 20, as is illustrated by compressed pressure valves 40. The cradle 38 normally is in the inactive position shown in FIG. 4. When dressing the grinding wheel the cradle 38 is rocked the desired number of times (as indicated by the dashed arc-shaped line in FIG. 4) to produce the desired dressing.

A problem to be considered in the dressing process is that the diameter of the grinding wheel diminishes as it is being worn, and this has to be compensated progressively. According to the invention this compensation is achieved by means of a step motor 41 driving a threaded step pin 42, which in turn supports the swinging arm 31 and raises the same a small distance each time that the step motor 41 and the step pin 42 are being rotated. A great advantage of such an arrangement is that one can obtain a very great accuracy in the compensation for the wear of the grinding wheel and that the magnitude of the rise of the swinging arm can be adjusted in a simple manner, e.g. by changing the angular displacement of the step motor 41 in each step and/or by changing the pitch of the step pin 42. (Normally the compensation is of the order of $10^{-2}$ mm per step.)

The skate sharpening machine according to the invention is also advantageously provided with further functions. It may especially be mentioned that the grinding wheel 29 preferably is water-cooled, as is illustrated by a nozzle 43. The cooling liquid is collected in a tank 44. In connection with the cooling nozzle 43, there is preferably a similarly directed compressed air nozzle for blowing the skate blade 3a clean and dry after the sharpening operation has been completed, for example while the skate is being returned to the loading device 2.

The skate sharpening machine according to the invention also comprises a programmed computer unit 45, which controls and coordinates the various details and functions of the machine depending on program variables, settings and selections of the control and function panel 4, signals from the sensor 16 and the detector 28, possible detectors for sensing the condition of the various active components, etc. This technique is today completely conventional to a person skilled in the art, who has no difficulties in designing and programming the computer unit 45 in a suitable manner with the guidance of the above disclosure, including the drawings.

It is also obvious to a person skilled in the art that the details of the driving and the power sources for the various movable parts of the skate sharpening machine according to the invention can easily be modified.

The invention is, of course, not intended to be restricted to the specific embodiments which have been desribed above and shown in the drawings, but many modifications and variations are possible within the scope of the appended claims.

We claim:

1. A skate sharpening device comprising an automatic skate sharpening mechanism located inside a protective cover, including a skate loading device (2), which is pivotally mounted in an opening (9) in said protective cover (1), so that it can be pivoted between a skate loading position outside said protective cover (1) and a starting position for sharpening inside said protective cover (1), said skate loading device comprising:

(a) gripping means (12, 15) for releasably gripping at least one skate (3) to be sharpened, (b) first obturation means (11a) which substantially close said opening (9) in said skate loading position (FIG. 5), and (c) second obturation means (11b) which substantially close said opening (9) in said starting position for sharpening (FIG. 6).

2. A skate sharpening device according to claim 1 wherein the pivot axis (2c) of said skate loading device is substantially horizontal.

3. A skate sharpening device according to claim 1, wherein said skate loading device comprises two shank portions (11a, 11b) making an angle with each other, preferably being perpendicular to each other, and forming said first and second obturation means, and in that the pivot axis of said skate loading device substantially passes through the junction (2*c*) of said two shank portions (11*a*, 11*b*).

4. A skate sharpening device according to claim 2 wherein said gripping means comprises a slot (12) in one of said shank portions (11*a*, 11*b*) for receiving a skate blade (3*a*).

5. A skate sharpening device according to claim 4 wherein one of said shank portions (11*b*) comprises a stop means for the trailing edge of a skate blade (3) carried by the other of said shank portions (11*a*), the skate blade being in a defined loading position in said loading device when its trailing edge contacts said stop means.

6. A skate sharpening device according to claim 1 comprising sensor means (16) for detecting that a skate (3) is correctly positioned in either said loading position or said starting position for sharpening.

7. A skate sharpening device according to claim 1 comprising means (27) for catching a skate (3) from said skate loading device (2) when the same is in said starting position for sharpening, means (22) for transporting the skate to said skate sharpening mechanism, means (29) for carrying out the sharpening operation, and means (22, 27) for returning the sharpened skate to said starting position.

8. A skate sharpening device according to claim 7, wherein said catching means comprises jaw means (27) gripping the skate blade at the mid-portion thereof.

9. A skate sharpening device according to claim 8, comprising position sensing means wherein said sensing means is a photo detector (28) for detecting the position of the front edge of the skate blade in said starting position for sharpening, means for calculating the mid-point of the skate blade on the basis of said detected position and said defined loading position in said loading device, and drive means for actuating said jaw means (27) in response thereto.

10. A skate sharpening device according to claim 9, wherein said skate sharpening mechanism comprises a slide (22), which is movable in the longitudinal direction of the skate (3), carries said jaw means (27) and said position sensing means (28), and transports the skate (3) from said starting position for sharpening, at least once to-and-fro over a sharpening means (29), and back to said starting position.

* * * * *